US007585821B2

(12) United States Patent
Emert et al.

(10) Patent No.: US 7,585,821 B2
(45) Date of Patent: Sep. 8, 2009

(54) MODIFIED DETERGENTS AND LUBRICATING OIL COMPOSITIONS CONTAINING SAME

(75) Inventors: Jacob Emert, Brooklyn, NY (US); Antonio Gutierrez, Mercerville, NJ (US)

(73) Assignee: Infineum International Limited (GB)

( * ) Notice: Subject to any disclaimer, the term of this patent is extended or adjusted under 35 U.S.C. 154(b) by 716 days.

(21) Appl. No.: 10/212,858

(22) Filed: Aug. 6, 2002

(65) Prior Publication Data

US 2004/0029747 A1 Feb. 12, 2004

(51) Int. Cl.
*C10M 141/06* (2006.01)
*C10M 159/12* (2006.01)
*C10M 159/20* (2006.01)

(52) U.S. Cl. ..... 508/232; 508/236; 508/239; 508/240; 508/287; 508/293; 508/295; 508/306; 508/391; 508/393; 508/460; 508/542; 508/586

(58) Field of Classification Search ..... 508/291, 508/295, 393, 460, 586, 232, 236, 239, 240
See application file for complete search history.

(56) References Cited

U.S. PATENT DOCUMENTS 3,401,117 A 9/1968 Schiff ..... 252/33
4,328,111 A * 5/1982 Watson et al. ..... 508/393
4,502,970 A * 3/1985 Schetelich et al. ..... 508/192
5,069,804 A * 12/1991 Marsh et al. ..... 508/460
5,356,552 A * 10/1994 Harrison et al. ..... 508/291
5,602,084 A * 2/1997 Moreton ..... 508/391
6,090,759 A * 7/2000 Cane et al. ..... 508/460
6,090,760 A * 7/2000 Cane et al. ..... 508/460
6,107,259 A * 8/2000 Muir et al. ..... 508/393
6,284,717 B1 9/2001 Crane et al. ..... 508/258
6,358,892 B1 3/2002 Harrison et al. ..... 508/192
6,649,575 B2 * 11/2003 Robson ..... 508/294
6,743,757 B2 * 6/2004 Bell et al. ..... 508/192
6,770,605 B1 * 8/2004 Stachew et al. ..... 508/291

FOREIGN PATENT DOCUMENTS

EP 0 323 087 A1 7/1989

* cited by examiner

*Primary Examiner*—Ellen M McAvoy

(57) ABSTRACT

A modified lubricating oil detergent that is the reaction product of an oil soluble detergent comprising an alkali- or alkaline earth metal hydrocarbyl phenate, carboxylate or sulfonate and an α, β-unsaturated carbonyl compound; and lubricating oil compositions containing a combination of such a modified detergent and a nitrogen-containing dispersant.

6 Claims, No Drawings

MODIFIED DETERGENTS AND LUBRICATING OIL COMPOSITIONS CONTAINING SAME

The present invention relates to detergents for lubricating oil compositions and lubricating oil compositions that contain such detergents. More particularly, the present invention relates to modified detergents which, when used in combination with nitrogen-containing dispersants, provide lubricating oil compositions displaying improved seal compatibility without reduced dispersing or detergency properties.

BACKGROUND OF THE INVENTION

Additives have been commonly used to try to improve the performance of lubricating oils for gasoline and diesel engines. Additives, or additive packages, may be used for a number of purposes, such as to improve detergency, reduce engine wear, stabilize a lubricating oil against heat and oxidation, reduce oil consumption, inhibit corrosion and reduce friction loss. "Dispersants" are used to maintain in suspension, within the oil, insoluble materials formed by oxidation and other mechanisms during the use of the oil, and prevent sludge flocculation and the precipitation of insoluble materials. Another function of the dispersant is to prevent the agglomeration of soot particles, thus reducing increases in the viscosity of the lubricating oil upon use.

Most dispersants in use today are reaction products of (1) a polyalkenyl-substituted mono- or dicarboxylic acid, anhydride or ester (e.g., polyisobutenyl succinic anhydride), also commonly referred to as a carboxylic acid acylating agent; and (2) a nucleophilic reactant (e.g., an amine, alcohol, amino alcohol or polyol). The ratio of mono- or dicarboxylic acid producing moieties per polyalkenyl moieties can be referred to as the "functionality" of the acylating agent. Most commonly, the nucleophilic reactant is an amine. In order to improve dispersant performance, the trend has been to increase the functionality of the dispersant backbone, and ultimately, increase the average number,of amine moieties per dispersant molecule, and the nitrogen content of the dispersant.

With increasing levels of dispersant nitrogen required to disperse the high level of soot found in modem internal combustion engines, particularly modem diesel engines, compatibility with fluoroelastic engine seal materials has become an issue. A number of approaches to reducing the aggressiveness of dispersant nitrogen have been described. Specifically, to attenuate the deterioration of fluoroelastic seals, the nitrogen of nitrogen-containing dispersants has been rendered non-basic by reaction with various "capping agents". For example, nitrogen-containing dispersants have been borated and reacted reaction with acids, anhydrides or aldehydes. Although such capping agents generally improve seal compatibility, capping frequently reduces the dispersing properties of the dispersant. Further, direct capping of the dispersant oftentimes causes the viscosity of the dispersant to increase dramatically, making it difficult to blend dispersant concentrates without excessive dilution.

U.S. Pat. No. 3,401,117 describes nitrogen-containing dispersants formed by reaction of metal petroleum sulfonate, maleic anhydride and an amine. Although not used as such in the patent, metal petroleum sulfonates can be used as detergents. In said patent, a neutral metal petroleum sulfonate is maleated to allow for reaction with an amine, and subsequently aminated to provide a dispersant. The maleated metal petroleum sulfonate is strictly an intermediate, and the use thereof in a lubricating oil composition is not suggested.

It would be advantageous to provide lubricating oil compositions containing high levels of dispersant nitrogen from uncapped dispersants, that also display improved compatibility with fluoroelatomer engine seal materials. The present inventors have now found that by reacting a lubricating oil detergent with a certain compounds conventionally used to reduce the basisity of the nitrogen of nitrogen-containing dispersants, and using the resulting modified detergent in a lubricating oil composition also containing a basic nitrogen-containing dispersant, the seal compatibility of the lubricating oil composition can be improved without adversely affecting the performance of the detergent or dispersant.

SUMMARY OF THE INVENTION

In accordance with a first aspect of the invention, there is provided the reaction product of an overbased metal detergent and an α, β-unsaturated carbonyl compound, such as maleic anhydride.

In a second aspect of the invention, there is provided a lubricating oil composition comprising a major amount of an oil of lubricating viscosity and a minor amount of each of a modified detergent that is the reaction product of a neutral or overbased metal detergent and α, β-unsaturated carbonyl compound, and one or more dispersants comprising polyalkenyl-substituted mono- or dicarboxylic acid, anhydride or ester derivatized by reaction with an aminic nucleophilic reactant.

The present invention also includes a method for improving the seal compatibility of a lubricating oil composition comprising a nitrogen-containing dispersant, which method comprises using, in combination with the nitrogen-containing dispersant, a modified detergent that is the reaction product of a neutral or overbased metal detergent and α, β-unsaturated carbonyl compound.

Other and further objects, advantages and features of the present invention will be understood by reference to the following specification.

DETAILED DESCRIPTION OF THE INVENTION

Metal-containing or ash-forming detergents function as both detergents to reduce or remove deposits and as acid neutralizers or rust inhibitors, thereby reducing wear and corrosion and extending engine life. Detergents generally comprise a polar head with a long hydrophobic tail. The polar head comprises a metal salt of an acidic organic compound. The salts may contain a substantially stoichiometric amount of the metal in which case they are usually described as normal or neutral salts, and would typically have a total base number or TBN (as can be measured by ASTM D2896) of from 0 to 80. A large amount of a metal base may be incorporated by reacting excess metal compound (e.g., an oxide or hydroxide) with an acidic gas (e.g., carbon dioxide). The resulting overbased detergent comprises neutralized detergent as the outer layer of a metal base (e.g. carbonate) micelle. Such overbased detergents may have a TBN of 150 or greater, and typically will have a TBN of from 250 to 450 or more.

Detergents that may be used include oil-soluble neutral and overbased sulfonates, phenates, sulfurized phenates, thiophosphonates, salicylates, and naphthenates and other oil-soluble carboxylates of a metal, particularly the alkali or alkaline earth metals, e.g., barium, sodium, potassium, lithium, calcium, and magnesium. The most commonly used metals are calcium and magnesium, which may both be present in detergents used in a lubricant, and mixtures of calcium and/or magnesium with sodium. Particularly convenient metal detergents are neutral and overbased calcium sulfonates having TBN of from 20 to 450, neutral and overbased calcium phenates and sulfurized phenates having TBN of from 50 to 450 and neutral and overbased magnesium or calcium salicylates having a TBN of from 20 to 450. Combinations of detergents, whether overbased or neutral or both, may be used. In one preferred lubricating oil composition.

Sulfonates may be prepared from sulfonic acids which are typically obtained by the sulfonation of alkyl substituted aromatic hydrocarbons such as those obtained from the fractionation of petroleum or by the alkylation of aromatic hydrocarbons. Examples included those obtained by alkylating benzene, toluene, xylene, naphthalene, diphenyl or their halogen derivatives such as chlorobenzene, chlorotoluene and chloronaphthalene. The alkylation may be carried out in the presence of a catalyst with alkylating agents, such as olefins, having from about 3 to more than 70 carbon atoms. The alkaryl sulfonates usually contain from about 9 to about 80 or more carbon atoms, preferably from about 16 to about 60 carbon atoms per alkyl substituted aromatic moiety.

The oil soluble sulfonates or alkaryl sulfonic acids may be neutralized with oxides, hydroxides, alkoxides, carbonates, carboxylate, sulfides, hydrosulfides, nitrates, borates and ethers of the metal. The amount of metal compound is chosen having regard to the desired TBN of the final product but typically ranges from about 100 to 220 wt. % (preferably at least 125 wt. %) of that stoichiometrically required.

Metal salts of phenols and sulfurized phenols are prepared by reaction with an appropriate metal compound such as an oxide or hydroxide and neutral or overbased products may be obtained by methods well known in the art. Sulfurized phenols may be prepared by reacting a phenol with sulfur or a sulfur containing compound such as hydrogen sulfide, sulfur monohalide or sulfur dihalide, to form products which are generally mixtures of compounds in which 2 or more phenols are bridged by sulfur containing bridges.

Carboxylate detergents, e.g., salicylates, can be prepared by reacting an aromatic carboxylic acid with an appropriate metal compound such as an oxide or hydroxide and neutral or overbased products may be obtained by methods well known in the art. The aromatic moiety of the aromatic carboxylic acid can contain heteroatoms, such as nitrogen and oxygen. Preferably, the moiety contains only carbon atoms; more preferably the moiety contains six or more carbon atoms; for example benzene is a preferred moiety. The aromatic carboxylic acid may contain one or more aromatic moieties, such as one or more benzene rings, either fused or connected via alkylene bridges. The carboxylic moiety may be attached directly or indirectly to the aromatic moiety. Preferably the carboxylic acid group is attached directly to a carbon atom on the aromatic moiety, such as a carbon atom on the benzene ring. More preferably, the aromatic moiety also contains a second functional group, such as a hydroxy group or a sulfonate group, which can be attached directly or indirectly to a carbon atom on the aromatic moiety.

Preferred examples of aromatic carboxylic acids are salicylic acids and sulfurized derivatives thereof, such as hydrocarbyl substituted salicylic acid and derivatives thereof. Processes for sulfurizing, for example a hydrocarbyl-substituted salicylic acid, are known to those skilled in the art. Salicylic acids are typically prepared by carboxylation, for example, by the Kolbe-Schmitt process, of phenoxides, and in that case, will generally be obtained, normally in a diluent, in admixture with uncarboxylated phenol.

Preferred substituents in oil-soluble salicylic acids are alkyl substituents. In alkyl-substituted salicylic acids, the alkyl groups advantageously contain 5 to 100, preferably 9 to 30, especially 14 to 20, carbon atoms. Where there is more than one alkyl group, the average number of carbon atoms in all of the alkyl groups is preferably at least 9 to ensure adequate oil solubility.

Detergents useful in the practice of the present invention may also be "hybrid" detergents formed with mixed surfactant systems, e.g., phenate/salicylates, sulfonate/phenates, sulfonate/salicylates, sulfonates/phenates/salicylates, as described, for example, in pending U.S. patent application Nos. 09/180,435 and 09/180,436 and U.S. Pat. Nos. 6,153,565 and 6,281,179.

It is not unusual to add a detergent or other additive, to a lubricating oil, or additive concentrate, in a diluent, such that only a portion of the added weight represents an active ingredient (A.I.). For example, detergent may be added together with an equal weight of diluent in which case the "additive" is 50% A.I. detergent. As used herein, the term weight percent (wt. %), when applied to a detergent or other additive refers to the weight of active ingredient.

To provide the modified detergent, a metal-containing, or ash-forming, detergent is reacted with α, β-unsaturated carbonyl compound. Examples of suitable α, β-unsaturated carbonyl compounds include maleic acid and anhydride, alkyl and cycloalkyl maleic acid, itaconic acid and anhydride, acrylic acid and anhydride, methacrylic acid and anhydride and citriconic acid and anhydride. Preferred α, β-unsaturated carbonyl compounds include maleic anhydride, itaconic anhydride, acrylic acid and methacrylic acid, most preferably maleic anhydride. To provide the desired properties, the detergent is reacted with from about 0.5 to about 10, preferably from about 1 to about 6, more preferably from about 2 to about 5 wt. %, e.g., 2 to 4 wt. %, of the α, β-unsaturated carbonyl compound, based on the weight of detergent. The reaction can be carried out at temperatures of from about 30° C. to about 200° C., preferably from about 60° C. to about 150° C., more preferably from about 80° C. to about 120° C., for about 0.5 hours to about 8 hours. The reaction can be conducted neat, or using a conventional solvent media, such as a mineral lubricating oil solvent so that the final product is in a convenient lubricating oil solution that is entirely compatible with a lubricating oil base stock and these generally include lubricating oils having a kinematic viscosity (ASTM D-445) of from about 2 to about 40, preferably from about 5 to 20 centistokes at 99° C. Particularly preferred solvent media include primarily paraffinic mineral oils, such as Solvent Neutral 150 (SN150).

Dispersants useful in the context of the present invention include the range of nitrogen-containing, ashless (metal-free) dispersants known to be effective to reduce formation of deposits upon use in gasoline and diesel engines, when added to lubricating oils. The ashless, dispersants of the present invention comprise an oil soluble polymeric long chain backbone having functional groups capable of associating with particles to be dispersed. Typically, such dispersants have amine, amine-alcohol or amide polar moieties attached to the polymer backbone, often via a bridging group. The ashless dispersant may be, for example, selected from oil soluble salts, esters, amino-esters, amidst, imides and oxazolines of long chain hydrocarbon-substituted mono- and polycarboxylic acids or anhydrides thereof; thiocarboxylate derivatives of long chain hydrocarbons; long chain aliphatic hydrocarbons having polyamine moieties attached directly thereto; and Mannich condensation products formed by condensing a long chain substituted phenol with formaldehyde and polyalkylene polyamine.

Generally, each mono- or dicarboxylic acid-producing moiety will react with a nucleophilic group (amine or amide)

and the number of functional groups in the polyalkenyl-substituted carboxylic acylating agent will determine the number of nucleophilic groups in the finished dispersant.

The polyalkenyl moiety of the dispersant of the present invention has a number average molecular weight of from about at least about 1800, preferably between 1800 and 3000, such as between 2000 and 2800, more preferably from about 2100 to 2500, and most preferably from about 2200 to about 2400. The molecular weight of a dispersant is generally expressed in terms of the molecular weight of the polyalkenyl moiety as the precise molecular weight range of the dispersant depends on numerous parameters including the type of polymer used to derive the dispersant, the number of functional groups, and the type of nucleophilic group employed.

Polymer molecular weight, specifically $\overline{M}_n$, can be determined by various known techniques. One convenient method is gel permeation chromatography (GPC), which additionally provides molecular weight distribution information (see W. W. Yau, J. J. Kirkland and D. D. Bly, "Modem Size Exclusion Liquid Chromatography", John Wiley and Sons, New York, 1979). Another useful method for determining molecular weight, particularly for lower molecular weight polymers, is vapor pressure osmometry (see, e.g., ASTM D3592).

The polyalkenyl moiety from which dispersants of the present invention may be derived has a narrow molecular weight distribution (MWD), also referred to as polydispersity, as determined by the ratio of weight average molecular weight ($M_w$) to number average molecular weight ($M_n$). Specifically, polymers from which the dispersants of the present invention are derived have a $M_w/M_n$ of from about 1.5 to about 2.0, preferably from about 1.5 to about 1.9, most preferably from about 1.6 to about 1.8.

Suitable hydrocarbons or polymers employed in the formation of the dispersants of the present invention include homopolymers, interpolymers or lower molecular weight hydrocarbons. One family of such polymers comprise polymers of ethylene and/or at least one $C_3$ to $C_{28}$ alpha-olefin having the formula $H_2C{=}CHR^1$ wherein $R^1$ is straight or branched chain alkyl radical comprising 1 to 26 carbon atoms and wherein the polymer contains carbon-to-carbon unsaturation, preferably a high degree of terminal ethenylidene unsaturation. Preferably, such polymers comprise interpolymers of ethylene and at least one alpha-olefin of the above formula, wherein $R^1$ is alkyl of from 1 to 18 carbon atoms, and more preferably is alkyl of from 1 to 8 carbon atoms, and more preferably still of from 1 to 2 carbon atoms. Therefore, useful alpha-olefin monomers and comonomers include, for example, propylene, butene-1, hexene-1, octene-1, 4-methylpentene-1, decene-1, dodecene-1, tridecene-1, tetradecene-1, pentadecene-1, hexadecene-1, heptadecene-1, octadecene-1, nonadecene-1, and mixtures thereof (e.g., mixtures of propylene and butene-1, and the like). Exemplary of such polymers are propylene homopolymers, butene-1 homopolymers, ethylene-propylene copolymers, ethylene-butene-1 copolymers, propylene-butene copolymers and the like, wherein the polymer contains at least some terminal and/or internal unsaturation. Preferred polymers are unsaturated copolymers of ethylene and propylene and ethylene and butene-1. The interpolymers of this invention may contain a minor amount, e.g. 0.5 to 5 mole % of a $C_4$ to $C_{18}$ non-conjugated diolefin comonomer. However, it is preferred that the polymers of this invention comprise only alpha-olefin homopolymers, interpolymers of alpha-olefin comonomers and interpolymers of ethylene and alpha-olefin comonomers. The molar ethylene content of the polymers employed in this invention is preferably in the range of 0 to 80%, and more preferably 0 to 60%. When propylene and/or butene-1 are employed as comonomer(s) with ethylene, the ethylene content of such copolymers is most preferably between 15 and 50%, although higher or lower ethylene contents may be present.

These polymers may be prepared by polymerizing alpha-olefin monomer, or mixtures of alpha-olefin monomers, or mixtures comprising ethylene and at least one $C_3$ to $C_{28}$ alpha-olefin monomer, in the presence of a catalyst system comprising at least one metallocene (e.g., a cyclopentadienyl-transition metal compound) and an alumoxane compound. Using this process, a polymer in which 95% or more of the polymer chains possess terminal ethenylidene-type unsaturation can be provided. The percentage of polymer chains exhibiting terminal ethenylidene unsaturation may be determined by FTIR spectroscopic analysis, titration, or $C^{13}$ NMR. Interpolymers of this latter type may be characterized by the formula POLY-$C(R^1){=}CH_2$ wherein $R^1$ is $C_1$ to $C_{26}$ alkyl, preferably $C_1$ to $C_{18}$ alkyl, more preferably $C_1$ to $C_8$ alkyl, and most preferably $C_1$ to $C_2$ alkyl, (e.g., methyl or ethyl) and wherein POLY represents the polymer chain. The chain length of the $R^1$ alkyl group will vary depending on the comonomer(s) selected for use in the polymerization. A minor amount of the polymer chains can contain terminal ethenyl, i.e., vinyl, unsaturation, i.e. POLY-$CH{=}CH_2$, and a portion of the polymers can contain internal monounsaturation, e.g. POLY-$CH{=}CH(R^1)$, wherein $R^1$ is as defined above. These terminally unsaturated interpolymers may be prepared by known metallocene chemistry and may also be prepared as described in U.S. Pat. Nos. 5,498,809; 5,663,130; 5,705,577; 5,814,715; 6,022,929 and 6,030,930.

Another useful class of polymers is polymers prepared by cationic polymerization of isobutene, styrene, and the like. Common polymers from this class include polyisobutenes obtained by polymerization of a $C_4$ refinery stream having a butene content of about 35 to about 75% by wt., and an isobutene content of about 30 to about 60% by wt., in the presence of a Lewis acid catalyst, such as aluminum trichloride or boron trifluoride. A preferred source of monomer for making poly-n-butenes is petroleum feedstreams such as Raffinate II. These feedstocks are disclosed in the art such as in U.S. Pat. No. 4,952,739. Polyisobutylene is a most preferred backbone of the present invention because it is readily available by cationic polymerization from butene streams (e.g., using $AlCl_3$ or $BF_3$ catalysts). Such polyisobutylenes generally contain residual unsaturation in amounts of about one ethylenic double bond per polymer chain, positioned along the chain. A preferred embodiment utilizes polyisobutylene prepared from a pure isobutylene stream or a Raffinate I stream to prepare reactive isobutylene polymers with terminal vinylidene olefins. Preferably, these polymers, referred to as highly reactive polyisobutylene (HR-PIB), have a terminal vinylidene content of at least 65%, e.g., 70%, more preferably at least 80%, most preferably, at least 85%. The preparation of such polymers is described, for example, in U.S. Pat. No. 4,152,499. HR-PIB is known and HR-PIB is commercially available under the tradenames Glissopal™ (from BASF) and Ultravis™ (from BP-Amoco).

Polyisobutylene polymers that may be employed are generally based on a hydrocarbon chain of from about 1800 to 3000. Methods for making polyisobutylene are known. Polyisobutylene can be functionalized by halogenation (e.g. chlorination), the thermal "ene" reaction, or by free radical grafting using a catalyst (e.g. peroxide), as described below.

The hydrocarbon or polymer backbone can be functionalized, e.g., with carboxylic acid producing moieties (preferably acid or anhydride moieties) selectively at sites of carbon-to-carbon unsaturation on the polymer or hydrocarbon chains, or randomly along chains using any of the three processes mentioned above or combinations thereof, in any sequence.

Processes for reacting polymeric hydrocarbons with unsaturated carboxylic acids, anhydrides or esters and the preparation of derivatives from such compounds are disclosed in U.S. Pat. Nos. 3,087,936; 3,172,892; 3,215,707; 3,231,587; 3,272,746; 3,275,554; 3,381,022; 3,442,808; 3,565,804; 3,912,764; 4,110,349; 4,234,435; 5,777,025; 5,891,953; as well as EP 0 382 450 B1; CA-1,335,895 and GB-A-1,440,219. The polymer or hydrocarbon may be functionalized, for example, with carboxylic acid producing moieties (preferably acid or anhydride) by reacting the polymer or hydrocarbon under conditions that result in the addition of functional moieties or agents, i.e., acid, anhydride, ester moieties, etc., onto the polymer or hydrocarbon chains primarily at sites of carbon-to-carbon unsaturation (also referred to as ethylenic or olefinic unsaturation) using the halogen assisted functionalization (e.g. chlorination) process or the thermal "ene" reaction.

Selective functionalization can be accomplished by halogenating, e.g., chlorinating or brominating the unsaturated α-olefin polymer to about 1 to 8 wt. %, preferably 3 to 7 wt. % chlorine, or bromine, based on the weight of polymer or hydrocarbon, by passing the chlorine or bromine through the polymer at a temperature of 60 to 250° C., preferably 110 to 160° C., e.g., 120 to 140° C., for about 0.5 to 10, preferably 1 to 7 hours. The halogenated polymer or hydrocarbon (hereinafter backbone) is then reacted with sufficient monounsaturated reactant capable of adding the required number of functional moieties to the backbone, e.g., monounsaturated carboxylic reactant, at 100 to 250° C., usually about 180° C. to 235° C., for about 0.5 to 10, e.g., 3 to 8 hours, such that the product obtained will contain the desired number of moles of the monounsaturated carboxylic reactant per mole of the halogenated backbones. Alternatively, the backbone and the monounsaturated carboxylic reactant are mixed and heated while adding chlorine to the hot material.

While chlorination normally helps increase the reactivity of starting olefin polymers with monounsaturated functionalizing reactant, it is not necessary with some of the polymers or hydrocarbons contemplated for use in the present invention, particularly those preferred polymers or hydrocarbons which possess a high terminal bond content and reactivity. Preferably, therefore, the backbone and the monounsaturated functionality reactant, e.g., carboxylic reactant, are contacted at elevated temperature to cause an initial thermal "ene" reaction to take place. Ene reactions are known.

The hydrocarbon or polymer backbone can be functionalized by random attachment of functional moieties along the polymer chains by a variety of methods. For example, the polymer, in solution or in solid form, may be grafted with the monounsaturated carboxylic reactant, as described above, in the presence of a free-radical initiator. When performed in solution, the grafting takes place at an elevated temperature in the range of about 100 to 260° C., preferably 120 to 240° C. Preferably, free-radical initiated grafting would be accomplished in a mineral lubricating oil solution containing, e.g., 1 to 50 wt. %, preferably 5 to 30 wt. % polymer based on the initial total oil solution.

The free-radical initiators that may be used are peroxides, hydroperoxides, and azo compounds, preferably those that have a boiling point greater than about 100° C. and decompose thermally within the grafting temperature range to provide free-radicals. Representative of these free-radical initiators are azobutyronitrile, 2,5-dimethylhex-3-ene-2,5-bis-tertiary-butyl peroxide and dicumene peroxide. The initiator, when used, typically is used in an amount of between 0.005% and 1% by weight based on the weight of the reaction mixture solution. Typically, the aforesaid monounsaturated carboxylic reactant material and free-radical initiator are used in a weight ratio range of from about 1.0:1 to 30:1, preferably 3:1 to 6:1. The grafting is preferably carried out in an inert atmosphere, such as under nitrogen blanketing. The resulting grafted polymer is characterized by having carboxylic acid (or ester or anhydride) moieties randomly attached along the polymer chains: it being understood, of course, that some of the polymer chains remain ungrafted. The free radical grafting described above can be used for the other polymers and hydrocarbons of the present invention.

The preferred monounsaturated reactants that are used to. functionalize the backbone comprise mono- and dicarboxylic acid material, i.e., acid, anhydride, or acid ester material, including (i) monounsaturated $C_4$ to $C_{10}$ dicarboxylic acid wherein (a) the carboxyl groups are vicinyl, (i.e., located on adjacent carbon atoms) and (b) at least one, preferably both, of said adjacent carbon atoms are part of said mono unsaturation; (ii) derivatives of (i) such as anhydrides or $C_1$ to $C_5$ alcohol derived mono- or diesters of (i); (iii) monounsaturated $C_3$ to $C_{10}$ monocarboxylic acid wherein the carbon-carbon double bond is conjugated with the carboxy group, i.e., of the structure —C═C—CO—; and (iv) derivatives of (iii) such as $C_1$ to $C_5$ alcohol derived mono- or diesters of (iii). Mixtures of monounsaturated carboxylic materials (i)-(iv) also may be used. Upon reaction with the backbone, the monounsaturation of the monounsaturated carboxylic reactant becomes saturated. Thus, for example, maleic anhydride becomes backbone-substituted succinic anhydride, and acrylic acid becomes backbone-substituted propionic acid. Exemplary of such monounsaturated carboxylic reactants are fumaric acid, itaconic acid, maleic acid, maleic anhydride, chloromaleic acid, chloromaleic anhydride, acrylic acid, methacrylic acid, crotonic acid, cinnamic acid, and lower alkyl (e.g., $C_1$ to $C_4$ alkyl) acid esters of the foregoing, e.g., methyl maleate, ethyl fumarate, and methyl fumarate.

To provide the required functionality, the monounsaturated carboxylic reactant, preferably maleic anhydride, typically will be used in an amount ranging from about equimolar amount to about 100 wt. % excess, preferably 5 to 50 wt. % excess, based on the moles of polymer or hydrocarbon. Unreacted excess monounsaturated carboxylic reactant can be removed from the final dispersant product by, for example, stripping, usually under vacuum, if required.

The functionalized oil-soluble polymeric hydrocarbon backbone is then derivatized with a nitrogen-containing nucleophilic reactant, such as an amine, amino-alcohol, amide, or mixture thereof, to form a corresponding derivative. Amine compounds are preferred. Useful amine compounds for derivatizing functionalized polymers comprise at least one amine and can comprise one or more additional amine or other reactive or polar groups. These amines may be hydrocarbyl amines or may be predominantly hydrocarbyl amines in which the hydrocarbyl group includes other groups, e.g., hydroxy groups, alkoxy groups, amide groups, nitriles, imidazoline groups, and the like. Particularly useful amine compounds include mono- and polyamines, e.g., polyalkene and polyoxyalkylene polyamines of about 2 to 60, such as 2 to 40 (e.g., 3 to 20) total carbon atoms having about 1 to 12, such as 3 to 12, preferably 3 to 9, most preferably form about 6 to about 7 nitrogen atoms per molecule. Mixtures of amine compounds may advantageously be used, such as those prepared by reaction of alkylene dihalide with ammonia. Preferred amines are aliphatic saturated amines, including, for example, 1,2-diaminoethane; 1,3-diaminopropane; 1,4-diaminobutane; 1,6-diaminohexane; polyethylene amines such as diethylene triamine; triethylene tetramine; tetraethylene pentamine; and polypropyleneamines such as 1,2-propylene diamine; and di-(1,2-propylene)triamine. Such polyamine mixtures, known as PAM, are commercially available. Particularly preferred polyamine mixtures are mixtures derived by distilling the light ends from PAM products. The resulting mixtures, known as "heavy" PAM, or HPAM, are also commercially available. The properties and attributes of both PAM and/or HPAM are described, for example, in U.S. Pat. Nos. 4,938,881; 4,927,551; 5,230,714; 5,241,003; 5,565,128; 5,756,431; 5,792,730; and 5,854,186.

Other useful amine compounds include: alicyclic diamines such as 1,4-di(aminomethyl) cyclohexane and heterocyclic nitrogen compounds such as imidazolines. Another useful class of amines is the polyamido and related amido-amines as disclosed in U.S. Pat. Nos. 4,857,217; 4,956,107; 4,963,275; and 5,229,022. Also usable is tris(hydroxymethyl)amino methane (TAM) as described in U.S. Pat. Nos. 4,102,798; 4,113,639; 4,116,876; and UK 989,409. Dendrimers, star-like amines, and comb-structured amines may also be used. Similarly, one may use condensed amines, as described in U.S. Pat. No. 5,053,152. The functionalized polymer is reacted with the amine compound using conventional techniques as described, for example, in U.S. Pat. Nos. 4,234,435 and 5,229,022, as well as in EP-A-208,560.

A preferred dispersant composition is one comprising at least one polyalkenyl succinimide, which is the reaction product of a polyalkenyl substituted succinic anhydride (e.g., PIBSA) and a polyamine that has a coupling ratio of from about 0.65 to about 1.25, preferably from about 0.8 to about 1.1, most preferably from about 0.9 to about 1. In the context of this disclosure, "coupling ratio" may be defined as a ratio of the number of succinyl groups in the PIBSA to the number of primary amine groups in the polyamine reactant.

Another class of high molecular weight ashless dispersants comprises Mannich base condensation products. Generally, these products are prepared by condensing about one mole of a long chain alkyl-substituted mono- or polyhydroxy benzene with about 1 to 2.5 moles of carbonyl compound(s) (e.g., formaldehyde and paraformaldehyde) and about 0.5 to 2 moles of polyalkylene polyamine, as disclosed, for example, in U.S. Pat. No. 3,442,808. Such Mannich base condensation products may include a polymer product of a metallocene catalyzed polymerization as a substituent on the benzene group, or may be reacted with a compound containing such a polymer substituted on a succinic anhydride in a manner similar to that described in U.S. Pat. No. 3,442,808. Examples of functionalized and/or derivatized olefin polymers synthesized using metallocene catalyst systems are described in the publications identified supra.

The dispersant(s) of the present invention are preferably non-polymeric (e.g., are mono- or bis-succinimides).

Lubricating oils useful in the practice of the invention may range in viscosity from light distillate mineral oils to heavy lubricating oils such as gasoline engine oils, mineral lubricating oils and heavy duty diesel oils. Generally, the viscosity of the oil ranges from about 2 $mm^2$/sec (centistokes) to about 40 $mm^2$/sec, especially from about 4 $mm^2$/sec to about 20 $mm^2$/sec, as measured at 100° C.

Natural oils include animal oils and vegetable oils (e.g., castor oil, lard oil); liquid petroleum oils and hydrorefined, solvent-treated or acid-treated mineral oils of the paraffinic, naphthenic and mixed paraffinic-naphthenic types. Oils of lubricating viscosity derived from coal or shale also serve as useful base oils.

Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-hexenes), poly(1-octenes), poly(1-decenes)); alkylbenzenes (e.g., dodecylbenzenes, tetradecylbenzenes, dinonylbenzenes, di(2-ethylhexyl)benzenes); polyphenyls (e.g., biphenyls, terphenyls, alkylated polyphenols); and alkylated diphenyl ethers and alkylated diphenyl sulfides and derivative, analogs and homologs thereof.

Alkylene oxide polymers and interpolymers and derivatives thereof where the terminal hydroxyl groups have been modified by esterification, etherification, etc., constitute another class of known synthetic lubricating oils. These are exemplified by polyoxyalkylene polymers prepared by polymerization of ethylene oxide or propylene oxide, and the alkyl and aryl ethers of polyoxyalkylene polymers (e.g., methyl-polyiso-propylene glycol ether having a molecular weight of 1000 or diphenyl ether of poly-ethylene glycol having a molecular weight of 1000 to 1500); and mono- and polycarboxylic esters thereof, for example, the acetic acid esters, mixed $C_3$-$C_8$ fatty acid esters and $C_{13}$ Oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Specific examples of such esters includes dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and polyol esters such as neopentyl glycol, trimethylolpropane, pentaerythritol, dipentaerythritol and tripentaerythritol.

Silicon-based oils such as the polyalkyl-, polyaryl-, polyalkoxy- or polyaryloxysilicone oils and silicate oils comprise another useful class of synthetic ubricants; such oils include tetraethyl silicate, tetraisopropyl silicate, tetra-(2-ethylhexyl) silicate, tetra-(4-methyl-2-ethylhexyl)silicate, tetra-(p-tert-butyl-phenyl) silicate, hexa-(4-methyl-2-ethylhexyl)disiloxane, poly(methyl)siloxanes and poly(methylphenyl) siloxanes. Other synthetic lubricating oils include liquid esters of phosphorous-containing acids (e.g., tricresyl phosphate, trioctyl phosphate, diethyl ester of decylphosphonic acid) and polymeric tetrahydrofurans.

Unrefined, refined and re-refined oils can be used in lubricants of the present invention. Unrefined oils are those obtained directly from a natural or synthetic source without further purification treatment. For example, a shale oil obtained directly from retorting operations; petroleum oil obtained directly from distillation; or ester oil obtained directly from an esterification and used without further treatment would be an unrefined oil. Refined oils are similar to unrefined oils except that the oil is further treated in one or more purification steps to improve one or more properties. Many such purification techniques, such as distillation, solvent extraction, acid or base extraction, filtration and percolation are known to those skilled in the art. Re-refined oils are obtained by processes similar to those used to provide refined oils but begin with oil that has already been used in service. Such re-refined oils are also known as reclaimed or reprocessed oils and are often subjected to additionally processing using techniques for removing spent additives and oil breakdown products.

The oil of lubricating viscosity may comprise a Group I, Group II, Group III, Group IV or Group V base stocks or base oil blends of the aforementioned base stocks. Preferably, the oil of lubricating viscosity is a Group III, Group IV or Group V base stock, or a mixture thereof provided that the volatility of the oil or oil blend, as measured by the NOACK test (ASTM D5880), is less than or equal to 13.5%, preferably less than or equal to 12%, more preferably less than or equal to 10%, most preferably less than or equal to 8%; and a viscosity index (VI) of at least 120, preferably at least 125, most preferably from about 130 to 140.

Definitions for the base stocks and base oils in this invention are the same as those found in the American Petroleum Institute (API) publication "Engine Oil Licensing and Certification System", Industry Services Department, Fourteenth Edition, December 1996, Addendum 1, December 1998. Said publication categorizes base stocks as follows:

a.) Group I base stocks contain less than 90 percent saturates and/or greater than 0.03 percent sulfur and have a viscosity index greater than or equal to 80 and less than 120 using the test methods specified in Table E-1.

b.) Group II base stocks contain greater than or equal to 90 percent saturates and less than or equal to 0.03 percent sulfur and have a viscosity index greater than or equal to 80 and less than 120 using the test methods specified in Table E-1.

c.) Group III base stocks contain greater than or equal to 90 percent saturates and less than or equal to 0.03 percent sulfur and have a viscosity index greater than or equal to 120 using the test methods specified in Table E-1.

d.) Group IV base stocks are polyalphaolefins (PAO).

e.) Group V base stocks include all other base stocks not included in Group I, II, III, or IV.

Analytical Methods for Base Stock

| Property | Test Method |
|---|---|
| Saturates | ASTM D 2007 |
| Viscosity Index | ASTM D 2270 |
| Sulfur | ASTM D 2622 |
| | ASTM D 4294 |
| | ASTM D 4927 |
| | ASTM D 3120 |

The modified detergent of the present invention can be incorporated into the lubricating oil in any convenient way. Thus, the detergent of the invention can be added directly to the oil by dispersing or dissolving the same in the oil at the desired level of concentrations. Such blending into the lubricating oil can occur at room temperature or elevated temperatures. Alternatively, the modified detergents of the invention can be introduced into the lubricating oil composition by blending the modified detergent with a suitable oil-soluble solvent and base oil to form a concentrate, and then blending the concentrate with a lubricating oil basestock to obtain the final formulation. Such concentrates will typically contain (on an active ingredient (A.I.) basis from about 10 to about 35 wt. %, and preferably from about 20 to about 30 wt. %, of the inventive detergent, and typically from about 40 to 80 wt. %, preferably from about 50 to 70 wt. %, base oil, based on the concentrate weight.

The modified detergents of the present invention may be neutral or overbased. Preferably, the modified detergents of the invention are overbased to provide a TBN of from about 70 to 500, preferably from about 100 to 400, more preferably from about 150 to about 400, e.g., 250 to 350.

Because reaction with the α, β-unsaturated carbonyl compound does not adversely affect detergency, the modified detergent can be used in conventional amounts. To provide sufficient detergency and rust inhibiting characteristics, the fully formulated lubricating oil composition should contain from about 0.1 to about 8 wt. %, preferably from about 0.3 to about 5 wt. %, most preferably from about 0.5 to about 3 wt. %, e.g., 1 to 2 wt. % (based on A.I.) of detergent. Detergency and rust inhibiting properties can be provided solely by use of the modified detergent of the present invention. Alternatively, a combination of a modified detergent, and an additional amount of an unmodified detergent can be used.

To improve the seal compatibility of the nitrogen-containing dispersant, the modified detergent should be present in an amount providing from about 0.01 to about 1, preferably from about 0.02 to about 0.5, more preferably from about 0.03 to about 0.3, e.g., 0.05 to 0.2 moles of detergent α, β-unsaturated carbonyl moiety per mole of dispersant nitrogen. The nitrogen-containing dispersant should provide the lubricating oil composition with from about 0.04 to about 0.15, preferably from about 0.05 to 0.12, more preferably 0.06 to 0.11, e.g., 0.07 to 0.1 wt. % nitrogen, and the ratio of wt. % nitrogen-containing dispersant to wt. % of modified detergent is from about 1:1 to about 10:1, preferably from about 2:1 to about 7:1.

Additional additives may be incorporated into the compositions of the invention to enable particular performance requirements to be met. Examples of additives which may be included in the lubricating oil compositions of the present invention are metal rust inhibitors, viscosity index improvers, corrosion inhibitors, oxidation inhibitors, friction modifiers, anti-foaming agents, anti-wear agents and pour point depressants. Some are discussed in further detail below.

Dihydrocarbyl dithiophosphate metal salts are frequently used as antiwear and antioxidant agents. The metal may be an alkali or alkaline earth metal, or aluminum, lead, tin, molybdenum, manganese, nickel or copper. The zinc salts are most commonly used in lubricating oil in amounts of 0.1 to 10, preferably 0.2 to 2 wt. %, based upon the total weight of the lubricating oil composition. They may be prepared in accordance with known techniques by first forming a dihydrocarbyl dithiophosphoric acid (DDPA), usually by reaction of one or more alcohol or a phenol with $P_2S_5$ and then neutralizing the formed DDPA with a zinc compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the zinc salt, any basic or neutral zinc compound could be used but the oxides, hydroxides and carbonates are most generally employed. Commercial additives frequently contain an excess of zinc due to the use of an excess of the basic zinc compound in the neutralization reaction.

The preferred zinc dihydrocarbyl dithiophosphates are oil soluble salts of dihydrocarbyl dithiophosphoric acids and may be represented by the following formula:

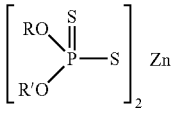

wherein R and R' may be the same or different hydrocarbyl radicals containing from 1 to 18, preferably 2 to 12, carbon atoms and including radicals such as alkyl, alkenyl, aryl, arylalkyl, alkaryl and cycloaliphatic radicals. Particularly preferred as R and R' groups are alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl. In order to obtain oil solubility, the total number of carbon atoms (i.e. R and R') in the dithiophosphoric acid will generally be about 5 or greater. The zinc dihydrocarbyl dithiophosphate can therefore comprise zinc dialkyl dithiophosphates. The present invention may be particularly useful when used with lubricant compositions containing phosphorus levels of from about 0.02 to about 0.12 wt. %, preferably from about 0.03 to about 0.10 wt. %. More preferably, the phosphorous level of the lubricating oil composition will be less than about 0.08 wt. %, such as from about 0.05 to about 0.08 wt. %.

Oxidation inhibitors or antioxidants reduce the tendency of mineral oils to deteriorate in service. Oxidative deterioration can be evidenced by sludge in the lubricant, varnish-like deposits on the metal surfaces, and by viscosity growth. Such oxidation inhibitors include hindered phenols, alkaline earth metal salts of alkylphenolthioesters having preferably $C_5$ to $C_{12}$ alkyl side chains, calcium nonylphenol sulfide, oil soluble phenates and sulfurized phenates, phosphosulfurized or sulfurized hydrocarbons or esters, phosphorous esters, metal thiocarbamates, oil soluble copper compounds as described in U.S. Pat. No. 4,867,890, and molybdenum-containing compounds.

Aromatic amines having at least two aromatic groups attached directly to the nitrogen constitute another class of compounds that is frequently used for antioxidancy. While these materials may be used in small amounts, preferred embodiments of the present invention are free of these compounds. They are preferably used in only small amounts, i.e., up to 0.4 wt. %, or more preferably avoided altogether other than such amount as may result as an impurity from another component of the composition.

Typical oil soluble aromatic amines having at least two aromatic groups attached directly to one amine nitrogen contain from 6 to 16 carbon atoms. The amines may contain more than two aromatic groups. Compounds having a total of at least three aromatic groups in which two aromatic groups are linked by a covalent bond or by an atom or group (e.g., an oxygen or sulfur atom, or a —CO—, —$SO_2$— or alkylene group) and two are directly attached to one amine nitrogen also considered aromatic amines having at least two aromatic groups attached directly to the nitrogen. The aromatic rings are typically substituted by one or more substituents selected from alkyl, cycloalkyl, alkoxy, aryloxy, acyl, acylamino, hydroxy, and nitro groups. The amount of any such oil soluble aromatic amines having at least two aromatic groups attached directly to one amine nitrogen should preferably not exceed 0.4 wt. % active ingredient.

Representative examples of suitable viscosity modifiers are polyisobutylene, copolymers of ethylene and propylene, polymethacrylates, methacrylate copolymers, copolymers of an unsaturated dicarboxylic acid and a vinyl compound, interpolymers of styrene and acrylic esters, and partially hydrogenated copolymers of styrene/isoprene, styrenelbutadiene, and isoprene/butadiene, as well as the partially hydrogenated homopolymers of butadiene and isoprene.

Friction modifiers and fuel economy agents that are compatible with the other ingredients of the final oil may also be included. Examples of such materials include glyceryl monoesters of higher fatty acids, for example, glyceryl monooleate; esters of long chain polycarboxylic acids with diols, for example, the butane diol ester of a dimerized unsaturated fatty acid; oxazoline compounds; and alkoxylated alkyl-substituted mono-amines, diamines and alkyl ether amines, for example, ethoxylated tallow amine and ethoxylated tallow ether amine. A preferred lubricating oil composition contains a dispersant composition of the present invention, base oil, and a nitrogen-containing friction modifier.

Other known friction modifiers comprise oil-soluble organo-molybdenum compounds. Such organo-molybdenum friction modifiers also provide antioxidant and antiwear credits to a lubricating oil composition. As an example of such oil soluble organo-molybdenum compounds, there may be mentioned the dithiocarbamates, dithiophosphates, dithiophosphinates, xanthates, thioxanthates, sulfides, and the like, and mixtures thereof. Particularly preferred are molybdenum dithiocarbamates, dialkyldithiophosphates, alkyl xanthates and alkylthioxanthates.

Additionally, the molybdenum compound may be an acidic molybdenum compound. These compounds will react with a basic nitrogen compound as measured by ASTM test D-664 or D-2896 titration procedure and are typically hexavalent. Included are molybdic acid, ammonium molybdate, sodium molybdate, potassium molybdate, and other alkaline metal molybdates and other molybdenum salts, e.g., hydrogen sodium molybdate, $MoOCl_4$, $MoO_2Br_2$, $Mo_2O_3Cl_6$, molybdenum trioxide or similar acidic molybdenum compounds.

Among the molybdenum compounds useful in the compositions of this invention are organo-molybdenum compounds of the formula $$Mo(ROCS_2)_4 \text{ and}$$

$$Mo(RSCS_2)_4$$

wherein R is an organo group selected from the group consisting of alkyl, aryl, aralkyl and alkoxyalkyl, generally of from 1 to 30 carbon atoms, and preferably 2 to 12 carbon atoms and most preferably alkyl of 2 to 12 carbon atoms. Especially preferred are the dialkyldithiocarbamates of molybdenum.

Another group of organo-molybdenum compounds useful in the lubricating compositions of this invention are trinuclear molybdenum compounds, especially those of the formula $Mo_3S_kL_nQ_z$ and mixtures thereof wherein the L are independently selected ligands having organo groups with a sufficient number of carbon atoms to render the compound soluble or dispersible in the oil, n is from 1 to 4, k varies from 4 through 7, Q is selected from the group of neutral electron donating compounds such as water, amines, alcohols, phosphines, and ethers, and z ranges from 0 to 5 and includes non-stoichiometric values. At least 21 total carbon atoms should be present among all the ligands' organo groups, such as at least 25, at least 30, or at least 35 carbon atoms.

The ligands are independently selected from the group of

1

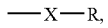

2

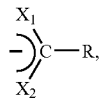

3

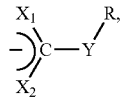

4

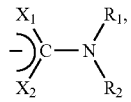

and

5

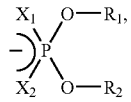

and mixtures thereof, wherein X, $X_1$, $X_2$, and Y are independently selected from the group of oxygen and sulfur, and wherein $R_1$, $R_2$, and R are independently selected from hydrogen and organo groups that may be the same or different. Preferably, the organo groups are hydrocarbyl groups such as alkyl (e.g., in which the carbon atom attached to the remainder of the ligand is primary or secondary), aryl, substituted aryl and ether groups. More preferably, each ligand has the same hydrocarbyl group.

The term "hydrocarbyl" denotes a substituent having carbon atoms directly attached to the remainder of the ligand and is predominantly hydrocarbyl in character within the context of this invention. Such substituents include the following:

1. Hydrocarbon substituents, that is, aliphatic (for example alkyl or alkenyl), alicyclic (for example cycloalkyl or cycloalkenyl) substituents, aromatic-, aliphatic- and alicyclic-substituted aromatic nuclei and the like, as well as cyclic substituents wherein the ring is completed through another portion of the ligand (that is, any two indicated substituents may together form an alicyclic group).

2. Substituted hydrocarbon substituents, that is, those containing non-hydrocarbon groups which, in the context of this invention, do not alter the predominantly hydrocarbyl character of the substituent. Those skilled in the art will be aware of suitable groups (e.g., halo, especially chloro and fluoro, amino, alkoxyl, mercapto, alkylmercapto, nitro, nitroso, sulfoxy, etc.).

3. Hetero substituents, that is, substituents which, while predominantly hydrocarbon in character within the context of this invention, contain atoms other than carbon present in a chain or ring otherwise composed of carbon atoms.

Importantly, the organo groups of the ligands have a sufficient number of carbon atoms to render the compound soluble or dispersible in the oil. For example, the number of carbon atoms in each group will generally range between about 1 to about 100, preferably from about 1 to about 30, and more preferably between about 4 to about 20. Preferred ligands include dialkyldithiophosphate, alkylxanthate, and dialkyldithiocarbamate, and of these dialkyldithiocarbamate is more preferred. Organic ligands containing two or more of the above functionalities are also capable of serving as ligands and binding to one or more of the cores. Those skilled in the art will realize that formation of the compounds of the present invention requires selection of ligands having the appropriate charge to balance the core's charge.

Compounds having the formula $Mo3S_kL_nQ_z$ have cationic cores surrounded by anionic ligands and are represented by structures such as

6

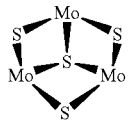

and

7

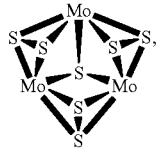

and have net charges of +4. Consequently, in order to solubilize these cores the total charge among all the ligands must be −4. Four monoanionic ligands are preferred. Without wishing to be bound by any theory, it is believed that two or more trinuclear cores may be bound or interconnected by means of one or more ligands and the ligands may be multidentate. Such structures fall within the scope of this invention. This includes the case of a multidentate ligand having multiple connections to a single core. It is believed that oxygen and/or selenium may be substituted for sulfur in the core(s).

Oil-soluble or dispersible trinuclear molybdenum compounds can be prepared by reacting in the appropriate liquid(s)/solvent(s) a molybdenum source such as $(NH_4)_2Mo_3S_{13}.n(H_2O)$, where n varies between 0 and 2 and includes non-stoichiometric values, with a suitable ligand source such as a tetralkylthiuram disulfide. Other oil-soluble or dispersible trinuclear molybdenum compounds can be formed during a reaction in the appropriate solvent(s) of a molybdenum source such as of $(NH_4)_2Mo_3S_{13}.n(H_2O)$, a ligand source such as tetralkylthiuram disulfide, dialkyldithiocarbamate, or dialkyldithiophosphate, and a sulfur abstracting agent such cyanide ions, sulfite ions, or substituted phosphines. Alternatively, a trinuclear molybdenum-sulfur halide salt such as $[M']_2[Mo_3S_7A_6]$, where M' is a counter ion, and A is a halogen such as Cl, Br, or I, may be reacted with a ligand source such as a dialkyldithiocarbamate or dialkyldithiophosphate in the appropriate liquid(s)/solvent(s) to form an oil-soluble or dispersible trinuclear molybdenum compound. The appropriate liquid/solvent may be, for example, aqueous or organic.

A compound's oil solubility or dispersibility may be influenced by the number of carbon atoms in the ligand's organo groups. In the compounds of the present invention, at least 21 total carbon atoms should be present among all the ligand's organo groups. Preferably, the ligand source chosen has a sufficient number of carbon atoms in its organo groups to render the compound soluble or dispersible in the lubricating composition.

The terms "oil-soluble" or "dispersible" used herein do not necessarily indicate that the compounds or additives are soluble, dissolvable, miscible, or capable of being suspended in the oil in all proportions. These do mean, however, that they are, for instance, soluble or stably dispersible in oil to an extent sufficient to exert their intended effect in the environment in which the oil is employed. Moreover, the additional incorporation of other additives may also permit incorporation of higher levels of a particular additive, if desired.

The molybdenum compound is preferably an organo-molybdenum compound. Moreover, the molybdenum compound is preferably selected from the group consisting of a molybdenum dithiocarbamate (MoDTC), molybdenum dithiophosphate, molybdenum dithiophosphinate, molybdenum xanthate, molybdenum thioxanthate, molybdenum sulfide and mixtures thereof. Most preferably, the molybdenum compound is present as molybdenum dithiocarbamate. The molybdenum compound may also be a trinuclear molybdenum compound.

A viscosity index improver dispersant functions both as a viscosity index improver and as a dispersant. Examples of viscosity index improver dispersants include reaction products of amines, for example polyamines, with a hydrocarbyl-substituted mono- or dicarboxylic acid in which the hydrocarbyl substituent comprises a chain of sufficient length to impart viscosity index improving properties to the compounds. In general, the viscosity index improver dispersant may be, for example, a polymer of a $C_4$ to $C_{24}$ unsaturated ester of vinyl alcohol or a $C_3$ to $C_{10}$ unsaturated mono-carboxylic acid or a $C_4$ to $C_{10}$ di-carboxylic acid with an unsaturated nitrogen-containing monomer having 4 to 20 carbon atoms; a polymer of a $C_2$ to $C_{20}$ olefin with an unsaturated $C_3$ to $C_{10}$ mono- or di-carboxylic acid neutralised with an amine, hydroxyamine or an alcohol; or a polymer of ethylene with a $C_3$ to $C_{20}$ olefin further reacted either by grafting a $C_4$ to $C_{20}$ unsaturated nitrogen-containing monomer thereon or by grafting an unsaturated acid onto the polymer backbone and then reacting carboxylic acid groups of the grafted acid with an amine, hydroxy amine or alcohol. A preferred lubricating oil composition contains a dispersant composition of the present invention, base oil, and a viscosity index improver dispersant.

Pour point depressants, otherwise known as lube oil flow improvers (LOFI), lower the minimum temperature at which the fluid will flow or can be poured. Such additives are well known. Typical of those additives that improve the low temperature fluidity of the fluid are $C_8$ to $C_{18}$ dialkyl fumarate/vinyl acetate copolymers, and polymethacrylates. Foam control can be provided by an antifoamant of the polysiloxane type, for example, silicone oil or polydimethyl siloxane.

Some of the above-mentioned additives can provide a multiplicity of effects; thus for example, a single additive may act as a dispersant-oxidation inhibitor. This approach is well known and need not be further elaborated herein.

In the present invention it may be necessary to include an additive which maintains the stability of the viscosity of the blend. Thus, although polar group-containing additives achieve a suitably low viscosity in the pre-blending stage it has been observed that some compositions increase in viscosity when stored for prolonged periods. Additives which are effective in controlling this viscosity increase include the long chain hydrocarbons functionalized by reaction with mono- or dicarboxylic acids or anhydrides which are used in the preparation of the ashless dispersants as hereinbefore disclosed.

When lubricating compositions contain one or more of the above-mentioned additives, each additive is typically blended into the base oil in an amount that enables the additive to provide its desired function. Representative effective amounts of such additives, when used in crankcase lubricants, are listed below. All the values listed are stated as mass percent active ingredient.

| ADDITIVE | MASS % (Broad) | MASS % (Preferred) |
|---|---|---|
| Metal Detergents | 0.1-15 | 0.2-9 |
| Corrosion Inhibitor | 0-5 | 0-1.5 |
| Metal Dihydrocarbyl Dithiophosphate | 0.1-6 | 0.1-4 |
| Antioxidant | 0-5 | 0.01-2 |
| Pour Point Depressant | 0.01-5 | 0.01-1.5 |
| Antifoaming Agent | 0-5 | 0.001-0.15 |
| Supplemental Antiwear Agents | 0-1.0 | 0-0.5 |
| Friction Modifier | 0-5 | 0-1.5 |
| Viscosity Modifier | 0.01-10 | 0.25-3 |
| Basestock | Balance | Balance |

Preferably, the Noack volatility of the fully formulated lubricating oil composition (oil of lubricating viscosity plus all additives) will be no greater than 12, such as no greater than 10, preferably no greater than 8.

It may be desirable, although not essential, to prepare one or more additive concentrates comprising additives (concentrates sometimes being referred to as additive packages) whereby several additives can be added simultaneously to the oil to form the lubricating oil composition.

The final composition may employ from 5 to 25 mass %, preferably 5 to 18 mass %, typically 10 to 15 mass % of the concentrate, the remainder being oil of lubricating viscosity.

This invention will be further understood by reference to the following examples, wherein all parts are parts by weight, unless otherwise noted and which include preferred embodiments of the invention.

EXAMPLES

Example 1

Preparation of Maleated Overbased Calcium Detergent (2%)

2500 grams of a 300 TBN overbased calcium detergent were charged into a five liter, four necked round bottom flask and heated to 80-85° C. with stirring under a nitrogen blanket. Thereafter, 50 grams of maleic anhydride (2%) were slowly added to the hot solution. The rate of addition of maleic anhydride was controlled by the amount of foaming produced during the reaction. Once the maleic anhydride addition was complete, the reaction mixture was soaked at 80-85° C. for one hour with stirring under a nitrogen blanket. The product was then cooled to room temperature and collected. The resulting product had a kinematic viscosity at 100° C. of 88.4 cSt compared to the viscosity of the starting detergent of 83.4 cSt. The maleic capped detergent analyzed for a TBN of about 300 and a 50/50 heptane sediment of 0.01 vol %.

Example 2

Preparation of Maleated Overbased Calcium Detergent (5%)

The procedure of Example 1 was followed except 125 grams of maleic anhydride (5%) were utilized in the reaction. The resulting product had a kinematic viscosity at 100° C. of 107.6 cSt compared to the viscosity of the starting detergent of 83.4 cSt. The maleic capped detergent analyzed for a TBN of about 300 and a 50/50 heptane sediment of 0.02 vol %.

Example 3

Preparation of Maleated Overbased Magnesium Detergent (2%)

500 grams of a 400 TBN overbased magnesium detergent were charged into a five liter, four necked round bottom flask and heated to 80-85° C. with stirring under a nitrogen blanket. Thereafter, 10 grams of maleic anhydride (2%) were slowly added to the hot solution. The rate of addition of maleic anhydride was controlled by the amount of foaming produced during the reaction. Once the maleic anhydride addition was complete, the reaction mixture was soaked at 80-85° C. for one hour with stirring under a nitrogen blanket. The product was then cooled to room temperature and collected. The resulting product had a kinematic viscosity at 100° C. of 120.9 cSt compared to the viscosity of the starting detergent of 109.2 cSt. The maleic capped detergent analyzed for a TBN of about 400 and a 50/50 heptane sediment of 0.01 vol %.

Example 4

Preparation Maleated Overbased Magnesium Detergent (5%)

The procedure of Example 3 was followed except 10 grams of maleic anhydride (5%) were utilized in the reaction. The product had a kinematic viscosity at 100° C. of 176 cSt compared to the viscosity of the starting detergent of 109.2 cSt. The maleic capped detergent analyzed for a TBN of about 400 and a 50/50 heptane sediment of 0.005 vol %.

Data relating to detergents prepared according to Examples 1-4 are summarized in Table I, in which Reference Detergents I and II are the 300 TBN overbased calcium detergent of Example 1, and the 400 TBN overbased magnesium detergent of Example 3, respectively.

TABLE I

| | Reference Detergent | |
|---|---|---|
| | I | II |
| KV-100, cSt | 83.42 | |
| Maleic Anhydride, wt % | 2 | 2 |
| KV-100° C., cSt | 88.4 | 120.9 |
| Sediment, vol % (50/50, hep) | 0.01 | 0.01 |
| Maleic Anhydride, wt % | 5 | 5 |
| KV-100° C., cSt | 107.6 | 175.5 |
| Sediment, vol % (50/50, hep) | 0.02 | 0.005 |

Comparative Example 5

Preparation of Maleic Anhydride Capped Dispersant (0.5%)

200 grams of polyalkenyl succinimide dispersant (1.2% N) were charged into a one liter, four necked round bottom flask and heated to 80-85° C. with stirring under a nitrogen blanket. Thereafter, 1.0 gram of maleic anhydride (0.5%) was slowly added to the hot solution. Once the maleic anhydride addition was complete, the reaction mixture was soaked at 150° C. for one hour with stirring under nitrogen sweeping to distill any water by-product. The product was then cooled to room temperature and collected. The resulting had a kinematic viscosity at 100°C. of 965 cSt compared to the viscosity of the starting dispersant of 627 cSt. The maleic anhydride-capped dispersant analyzed for a TBN of 20.9, 1.2% Nitrogen and a 50/50 heptane sediment of 0.005 vol. %.

Comparative Example 6

Preparation of Maleic Capped Dispersant (1%)

The procedure of Example 5 was followed except 2.0 grams of maleic anhydride (1.0%) were utilized in the reaction. The product had a kinematic viscosity at 100° C. of 1590 cSt compared to the viscosity of the starting dispersant of 627 cSt. The maleic capped dispersant analyzed for a TBN of 18.1, 1.19% Nitrogen and a 50/50 heptane sediment of 0.01 vol. %.

Comparative Example 7

Preparation of Maleic Capped Dispersant (2%)

The procedure of Example 5 was followed except 4.0 grams of maleic anhydride (2.0%) were utilized in the reaction. The product had a kinematic viscosity at 100° C. of 3837 cSt compared to the viscosity of the starting dispersant of 627 cSt. The maleic capped dispersant analyzed for a TBN of 15.1, 1.16% Nitrogen and a 50/50 heptane sediment of 0.01 vol. %.

Example 8

Impact of Modified Detergent on Soot Viscosity Control

The data of Table II show the impact of modified overbased detergents on soot viscosity control of formulated oils containing identical amounts of dispersant, detergent, antioxidant, ZDDP and viscosity modifier. The viscosities of suspensions of 4.76% carbon black were measured in a Haake viscometer at room temperature. The data show that the soot viscosity control capability of the oil is not adversely affected (and is actually improved), by modification of the detergent.

TABLE II

| | Oil | | |
|---|---|---|---|
| | 1 | 2 | 3 |
| Detergent | I | Ia (2% MA) | Ib (5% MA) |
| Viscosity at 1.25 sec-1 Shear Rate | 1.58 | 1.00 | 0.76 |

Example 9

Comparison of Viscosities of Concentrates Containing Maleated Detergents and Dispersants Two 15W40 formulations, A and B, were prepared from identical components comprising dispersant, detergent, viscosity modifier (VM), ZDDP and supplemental antioxidant. The dispersant treats in Formulations A and B were adjusted so that Formulation B represented about a 20% higher dispersant treat than Formulation A. All other components remained the same, except that the VM was adjusted to retain the same viscometrics for both formulations.

Table III shows the viscosities of additive concentrates containing maleated detergents and dispersants. The data indicate that concentrate viscosity increases only slightly when the reference detergent is replaced by maleated detergent, but doubles when the reference dispersant is replaced by maleated dispersant in amounts providing the oil with identical maleic anhydride contents.

TABLE III

| | KV-100 (cSt, 100 C.) | KV-100 (cSt, 100 C.) | KV-100 (cSt, 100 C.) | KV-100 (cSt, 100 C.) |
|---|---|---|---|---|
| Formulation | A | B | A | B |
| Dispersant | Ref | Ref | 0.5% MA capped | 0.5% MA capped |
| Detergent | | | | |
| I | 241.1 | 140.6 | 409.3 | 215.9 |
| Ia | 259.9 | 146.0 | | |
| Ib | 275.1 | 158.3 | | |

Example 10

Daimler-Chrysler Seal Compatibility of Lubricating Oil Compositions Containing Modified Detergents The impact of maleation of the reference 300 TBN overbased calcium detergents (I) in Daimler-Chrysler fluoroelastomer (Viton™) seal compatibility test (VDA 675 301) in the above formulations is shown in Table IV. Detergents Ia and Ib were maleated according to Examples 1 and 2, respectively.

Two additional 15W40 formulations (C and D) made with a 400 TBN overbased magnesium detergent (II) were compared to analogous formulations containing detergents prepared according to example 3-4 (Detergents IIa and IIb, respectively). The comparative seal data are shown in Table IV.

TABLE IV

| | Formulation | Tensile Strength | Elongation at Break |
|---|---|---|---|
| Reference Detergent-I | A | −52 | −48 |
| Maleated Detergent-Ia | A | −42 | −40 |
| Maleated Detergent-Ib | A | −40 | −41 |
| Reference Detergent-I | B | −54 | −50 |
| Maleated Detergent-Ia | B | −49 | −48 |
| Maleated Detergent-Ib | B | −47 | −43 |
| Reference Detergent-II | C | −42 | −40 |
| Maleated Detergent-IIa | C | −35 | −33 |
| Maleated Detergent-IIb | C | −22 | −29 |
| Reference Detergent-II | D | −47 | −42 |
| Maleated Detergent-IIa | D | −39 | −37 |
| Maleated Detergent-IIb | D | −38 | −37 |

The data in Tables I-IV clearly demonstrates that the materials of the invention enhance fluoroelastomer seal compatibility without adversely affecting soot dispersancy or component/concentrate viscosity.

The disclosures of all patents, articles and other materials described herein are hereby incorporated, in their entirety, into this specification by reference. Compositions described as "comprising" a plurality of defined components are to be construed as including compositions formed by admixing the defined plurality of defined components The principles, preferred embodiments and modes of operation of the present invention have been described in the foregoing specification. What applicants submit is their invention, however, is not to be construed as limited to the particular embodiments disclosed, since the disclosed embodiments are regarded as illustrative rather than limiting. Changes may be made by those skilled in the art without departing from the spirit of the invention.

What is claimed is:

1. A lubricating oil composition made by admixing:

(a) oil of lubricating viscosity;

(b) a nitrogen-containing dispersant; and (c) a modified detergent comprising the reaction product of:

(i) an overbased oil soluble detergent comprising an alkali- or alkaline earth metal hydrocarbyl phenate, carboxylate or sulfonate; and (ii) from about 0.5 to about 6 wt. %, based on the total weight of active product, of an α, β-unsaturated carbonyl compound selected from the group consisting of maleic anhydride, citraconic anhydride, alkyl maleic anhydride, cycloalkyl maleic anhydride, acrylic anhydride and methacrylic anhydride;

wherein said nitrogen-containing dispersant contributes from about 0.04 to about 0.15 wt. % of nitrogen to said composition and a ratio of wt. % of nitrogen-containing dispersant to wt. % of modified detergent is from about 2:1 to about 7.

2. The lubricating oil composition of claim 1, wherein said α, β-unsaturated carbonyl compound is maleic anhydride.

3. The lubricating oil composition of claim 1, wherein said nitrogen-containing dispersant comprises at least one polyalkenyl succinimide.

4. A method of improving the seal compatibility of lubricating oil compositions comprising nitrogen-containing dispersants, said method comprising, using in combination with said nitrogen-containing dispersant, a modified detergent comprising the reaction product of:

(i) an overbased oil soluble detergent comprising an alkali- or alkaline earth metal hydrocarbyl phenate, carboxylate or sulfonate; and (ii) from about 0.5 to about 6 wt. %, based on the total weight of active product, of an α, β-unsaturated carbonyl compound selected from the group consisting of maleic anhydride, citraconic anhydride, alkyl maleic anhydride, cycloalkyl maleic anhydride, acrylic anhydride and methacrylic anhydride;

wherein said nitrogen-containing dispersant contributes from about 0.04 to about 0.15 wt. % of nitrogen to said composition and a ratio of wt. % of nitrogen-containing dispersant to wt. % of modified detergent is from about 2:1 to about 7.

5. The method of claim 4, wherein said α, β-unsaturated carbonyl moiety is maleic anhydride.

6. The method of claim 1, wherein said nitrogen-containing dispersant comprises at least one polyalkenyl succinimide.

* * * * *